United States Patent [19]

Egami et al.

[11] 4,053,332

[45] Oct. 11, 1977

[54] ENHANCING MAGNETIC PROPERTIES OF AMORPHOUS ALLOYS BY ROLLING

[75] Inventors: Takeshi Egami, Narberth, Pa.; Philip J. Flanders, Moorestown, N.J.

[73] Assignee: University of Pennsylvania, Philadelphia, Pa.

[21] Appl. No.: 709,857

[22] Filed: July 29, 1976

Related U.S. Application Data

[63] Continuation of Ser. No. 507,860, Sept. 20, 1974, abandoned, which is a continuation-in-part of Ser. No. 495,787, Aug. 8, 1974, abandoned.

[51] Int. Cl.[2] ..... H01F 1/00

[52] U.S. Cl. ..... 148/120; 148/31.55; 75/123 D; 75/134 F; 75/170

[58] Field of Search ..... 148/120, 31.55; 75/170, 75/134 F, 123 D

[56] References Cited

U.S. PATENT DOCUMENTS

| | | | |
|---|---|---|---|
| 3,607,460 | 9/1971 | Lommel | 148/31.55 |
| 3,820,040 | 6/1974 | Berry et al. | 148/120 |
| 3,856,513 | 12/1974 | Chen et al. | 75/123 D |

*Primary Examiner*—Walter R. Satterfield
*Attorney, Agent, or Firm*—Paul & Paul

[57] ABSTRACT

A nickel based amorphous alloy in elongated ribbon form is passed between two rollers to obtain approximately a one third reduction in thickness. The rolled alloy samples may then be subjected to elastic tensile loading, which tends to increase remanence and decrease coercivity. The rolling process tends to reduce the unloaded remanence and thereby to improve the load versus remanence range sensitivity by a considerable amount.

8 Claims, 3 Drawing Figures

ENHANCING MAGNETIC PROPERTIES OF AMORPHOUS ALLOYS BY ROLLING

CROSS-REFERENCE TO PARENT

This is a continuation, of application Ser. No. 507,860 filed Sept. 20, 1974 and now abandoned, and in turn a continuation-in-part of Ser. No. 495,787, filed Aug. 8, 1974 and now abandoned.

BACKGROUND OF THE INVENTION

This invention relates to amorphous metallic alloys. More particularly, it relates to the enhancement of the magnetic properties of amorphous metallic alloys.

Amorphous metallic alloys, also sometimes referred to as "glassy metals," result when certain component materials are quenched from the molten state to the solid state at extremely high rates. For example, quenching at the rate of $10^{5°}$ per second has been found to result in an alloy which is substantially homogeneous and amorphous in form. That is, the rapid cooling process prevents formation of a crystalline structure in the alloy material.

Until rather recently, the only known technology for the production of amorphous alloys utilized techniques such as vacuum evaporation, sputtering, electrodeposition, and the like. Also, the materials produced by those processes were not of convenient size or shape for extensive further development for some purposes, and any attempts to alter the shape destroyed their amorphous, homogeneous character.

More recently, however, production techniques have been developed whereby amorphous alloys may be synthesized in a convenient ribbon shape, and at a cost which appears to be quite economical. Consequently, considerable academic and industrial efforts are being undertaken to develop useful applications for the amorphous alloy materials.

It is a primary object of the present invention to provide useful applications for the class of amorphous magnetic metallic alloys.

Relevant properties of amorphous metallic alloys may be summarized briefly. Although homogeneous in composition, the amorphous alloys typically possess considerable strength, in contrast to conventional high strength alloys, which consist of two or more phases. Rather than having standard stress-strain curve having a limited linear elastic range, followed by an elongated plastic strain region terminating at the ultimate strength, or breaking point, the amorphous alloys characteristically show a linear elastic region followed by a slightly nonlinear region ending at the breaking point. Amorphous alloys do not show the yield point behavior typical of crystalline alloys. The alloys do show some creep, the slow deformation which may occur over long periods of sustained loading. Magnetically, the alloys are "soft" materials, in that they possess relatively high permeability (i.e., the ratio of magnetic flux density produced in a medium to the magnetizing force producing it).

It is a more particular object of the present invention, in conformity with the foregoing properties of amorphous magnetic metallic alloys, to provide methods for enhancing the fundamental magnetic properties thereof, and further for utilizing the enhanced material in apparatus applications.

In a copending U.S. patent application of C. D. Graham, T. Egami, and P. J. Flanders, Ser. No. 709,875 filed contemporaneously herewith and assigned to the assignee hereof, there is disclosed a method of enhancing the magnetic properties of amorphous magnetic metallic alloys by application of stress.

It is a further object of the present invention to increase the stress responsive sensitivity of amorphous metallic alloys.

SUMMARY OF THE INVENTION

In accordance with the principles of the present invention, the beneficial results which accrue to the magnetic properties of amorphous alloys by application of stress are altered by the use of rolling. That is, if a sample of amorphous alloy is subjected to a compressive rolling process, and thence is stressed in the manner set forth in the foregoing copending application of C. D. Graham et al., the range of the sensitivity and the linearity of response of the sample is substantially enhanced. That is, the rolling tends drastically to reduce the unloaded remanence of the sample, but does not substantially affect the remanence quantities which are ultimately attainable by loading. Consequently, the stress responsive magnetic properties of the material are spread over a longer range.

In an illustrative embodiment, a ribbon of nickel based amorphous alloy is passed between two rollers to produce a 32% reduction in thickness, of which part is a 4% increase in width, and the rest is an increase in elongation. The rolled sample remains substantially amorphous and homogeneous. Whereas the unrolled, unloaded sample possess a remanence in the range of 35% of saturation, the rolled, unloaded sample has a remanence in the range of 2 to 3% of saturation depending on the maximum field applied. A loading of 50 kilograms per square millimeter, however, brings the remanence up to 60% of saturation.

DETAILED DESCRIPTION

As set forth hereinbefore, practicable production methods and alloys of useful form only have been developed recently. Thus, only a limited variety of different compositions have been available for development and application of the principles of the present invention. However, in view of the properties and behavior stimulated and observed, the principles of the present invention are seen to be generally applicable to amorphous metallic alloys.

As set forth in the foregoing copending application of C. D. Graham et al., the magnetic characteristics which may be advantageously manipulated are the low field properties. Unloaded, the amorphous magnetic alloys possess a relatively low remanence and relatively high coercivity. As stress is linearly increased in the elastic range, the remanence at first increases linearly, but then falls off to a nearly exponential approach to the magnetic saturation level of the material. At a certain loading point, however, and therebeyond up to the ultimate strength of the material, a fixed percentage near but below the saturation limit is achieved, and is maintained up to the breaking point. The coercivity correspondingly decreases with stress, but levels at a loading somewhat less than the limiting point for remanence. Thus, for a given amorphous magnetic metallic alloy, there exists only a certain range, or "window" in which stress loading has the desired effect. Unless that window is utilized, variation of magnetic properties with load will not be achieved. For maximum remanence and minimum coercive force, any stress at or above the limiting point, but short of a stress which will provide deformation or fracture may be utilized. Whenever the stress is removed, the magnetic properties of the alloy revert to those of the original, unstressed material.

In accordance with the principles of the present invention, the stress responsive enhanced magnetic properties of the alloy material are altered by rolling in that the useful window in which loading has the desired effect is translated to a much broader load range. Consequently, the window itself is substantially increased in size, with a consequently enhanced stress responsive sensitivity.

Since the material resulting from the rolling process has substantially similar, although much more linear stress related magnetic properties, depending on the field used, the rolled alloy samples may usually be used anywhere the unrolled samples may be used. For example, magnetic delay lines, may be advantageously composed of the rolled amorphous alloy materials in their stressed state. Moreover, however, high accuracy applications such as stress and strain gauges provide even better opportunities for application of the principles of the present invention.

It must be pointed out that the aforementioned range of stress is well above the yield point of conventional polycrystalline soft magnetic materials. Therefore, the application of the stress has beneficial effects exclusively upon amorphous materials. That is, if a stress of the aforementioned magnitude is applied to conventional soft magnetic materials, the materials will be severely plastically deformed causing serious adverse effects upon the low field magnetic properties, or they may even be fractured.

The principal merits of the use of amorphous materials under controlled stress are: (1) their low field properties, i.e., the remanence, the coercive field, the permeability, may excel those of the permalloys; (2) they are far less sensitive to mechanical damage than the permalloys, particularly than the supermalloys which are so sensitive to mechanical force that extreme care must be exercised in handling; (3) their electrical resistivity is significantly higher than the permalloys (e.g. 3 times), so that the high frequency performance is superior; and (4) their production cost could be significantly lower than the conventional materials, inasmuch as the number of rolling operations is greatly reduced, and heat treatment in a hydrogen environment is unnecessary.

All of the compositions thus far utilized have been possessed of positive magnetostriction. That is, when a magnetic field is imposed on the unstressed material, a slight physical expansion occurs. Generally, the stress applied in accordance with the principles of the present invention to enhance magnetic capabilities is a tensile stress for materials with positive magnetostriction, and a compressive stress for materials with negative magnetostriction.

For example, the rolled sample may be provided with three coils and attached in a stressed state to the apparatus being monitored. Preferably, the stress on the alloy is in the intermediate range, such that elongation or compression of the apparatus being monitored will translate into increased or decreased stress in the amorphous alloy, with consequent variation of the magnetic properties thereof. A first one of the coils is provided with a time variant signal, and a second is provided with an oppositely directed signal effectively to decouple the first and third coils. The third coil has current sensing apparatus coupled thereto, such that variations in the stress of the alloy material appropriately change the magnetic properties thereof, and the current which is induced in the third coil by the field setup from the first winding.

Another interesting property which arises in amorphous alloy materials which have been processed in accordance with the principles of the present invention is a considerable dependency of the magnetic parameters on a magnetic field which is impressed on the material. More particularly, after an amorphous alloy sample has been rolled, and the magnetic parameters have thereby been altered as set forth hereinbefore, still further alteration may be had by impressing a time variant magnetic field, preferably periodic such as sinusoidal, of predetermined amplitude onto the sample. More particularly, as the peak to peak amplitude of the impressed field is increased, the remanence versus load curve for the rolled sample increasingly tends toward the original remanence versus load curve for the undeformed sample.

Following are specific methods and tests which illustrate the principles of the present invention. Wherever appropriate, actual response curves and characteristics are submitted.

EXAMPLE

A ribbon shaped amorphous alloy sample 10cm long by 1.5mm wide by 35 micrometers thick, composed of nickel, [49] 40 atomic percent; iron, [29] 40 atomic percent; phosphorous, 14 atomic percent; and boron, 6 atomic percent[; and silicon, 2 atomic percent] was passed between rollers to achieve a thickness reduction of 31.5 percent. This thickness reduction was taken up in a 4% increase of width, and the remainder in an increase in length.

As set forth hereinbefore, stressed rolled amorphous alloy samples are considerable more responsive to variations of impressed magnetic fields than are the same samples without rolling. In order to demonstrate this effect, the rolled sample had periodic electrical signals of predetermined peak to peak value impress a magnetic field onto the sample while taking remanence and coercivity measurements in the standard fashion.

Figure 1:
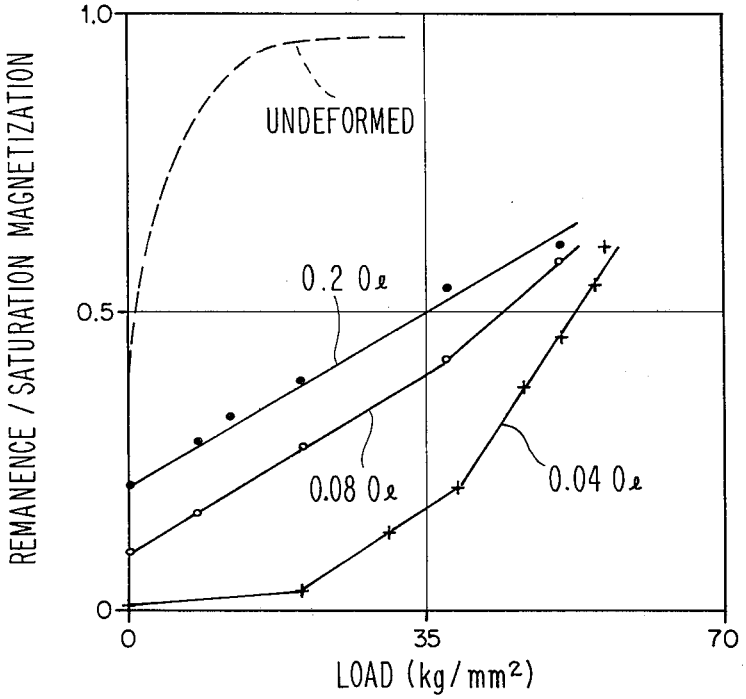
FIG. 1 shows a plot of remanence as a function of load and impressed field for a sample before and after rolling in accordance with the principles of the present invention.

In FIG. 1, the remanence to saturation magnetization ratio is plotted against increasing load for the sample prior to rolling, and for the rolled sample with three different fields impressed thereon. More particularly, the fields impressed are those induced by 60 hertz sinusoidal signals, yielding a peak magnetic field of 0.2 Oersted, 0.08 Oersted, and 0.04 Oersted. It may be seen that in all cases, the rolling has substantially reduced the unloaded remanence, but that the impressed magnetic field tends to push the remanence back upwardly toward that of the sample prior to rolling. Also, the rolling has substantially altered the shape of the remanence versus load characteristic, the lowest field plot even having the opposite direction of curvature. Increased impressed fields, however, tend to force the data points toward their value in the undeformed state, with the maximum field of 0.2 Oersteds producing a nearly linear remanence versus load characteristic. Also, the rolling of the amorphous alloy sample has substantially extended the load range over which remanence change can be had. Furthermore, by lowering the no load remanence value, the increased load responsiveness is not had with any penalty to the range of remanence change available.

Figure 2:
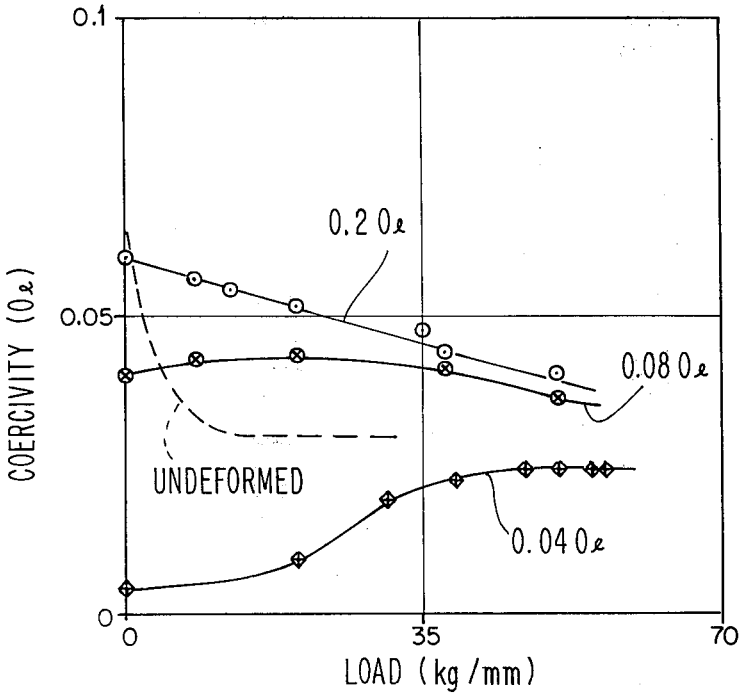
FIG. 2 shows similar plots of coercivity.

In FIG. 2, the coercivity change is shown for the loads and impressed fields of FIG. 1. For low field applications, the coercivity has been drastically reduced, from 0.065 Oersteds down to less than 0.005 Oersteds. As the impressed field is increased, the no load coercivity is pushed back upwardly toward that of the unrolled sample. However, the shape of the coercivity versus load characteristic, while translated upwardly by impressed field, is made more linear rather than assuming the shape of the coercivity characteristic for the unrolled sample. At a maximum field strength of 0.2 Oersteds, which corresponds to the linear remanence versus load characteristic of FIG. 1, the coercivity function also is substantially linear.

These linear portions are among those which may be exploited in excellent fashion for applications such as stress and strain gauges, delay lines, and the like.

Figure 3:
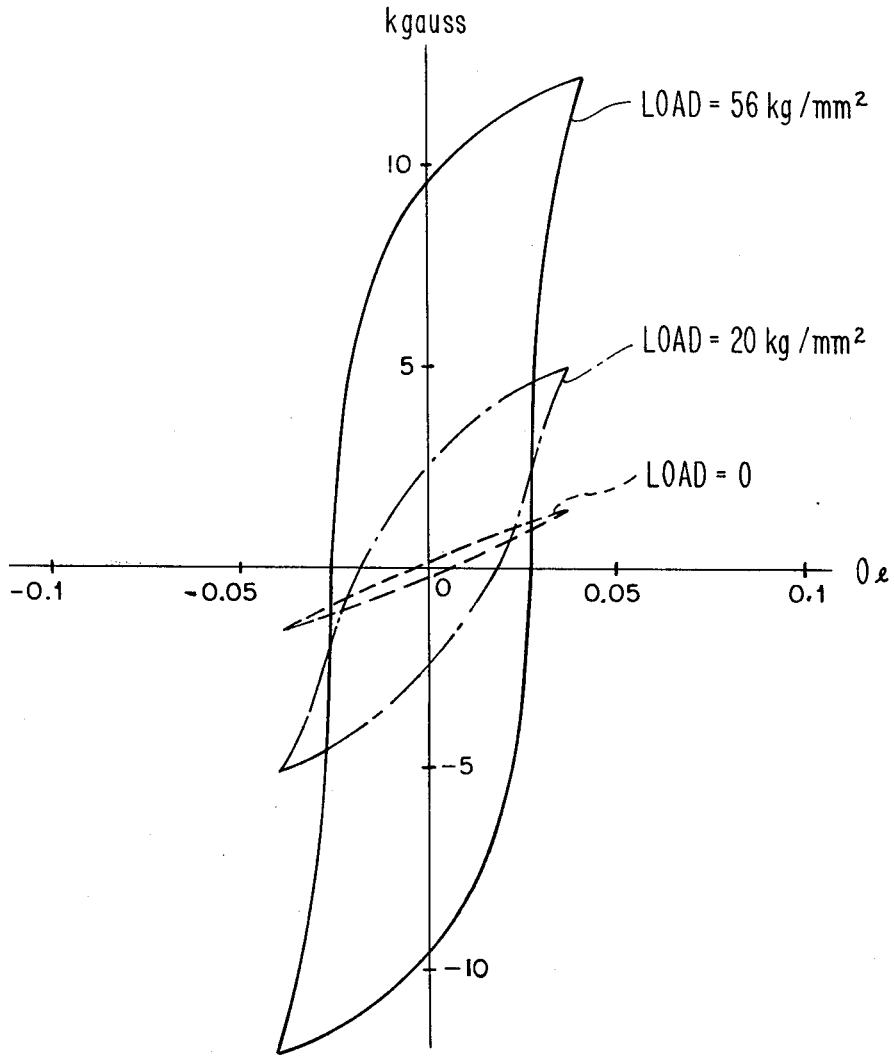
FIG. 3 shows illustrative hysteresis curves resulting from application of the principles of the present invention.

FIG. 3 shows hysteresis loops of conventional designation which are associated with the graphs of FIGS. 1 and 2.

We claim:

1. A method of providing a metal having enhanced magnetic properties comprising the steps of:
   selecting a sample from the class of amorphous metallic alloys;
   passing said sample through roller means to dimensionally alter said sample; and
   subjecting said dimensionally reduced sample to an elastic stress of predetermined magnitude.

2. A method as described in claim 1 wherein said selecting step includes selecting an elongated, ribbon shaped sample, and said passing step includes passing said sample between counterpoised oppositely rotating rollers, thereby reducing the thickness of said sample.

3. A method as described in claim 1 wherein said sample is selected from the class of iron based amorphous alloys.

4. A method of providing a metal having controlled stress sensitivity of soft magnetic properties including coercivity and remanence, comprising the steps of:
   a. selecting a metal from the group consisting of substantially amorphous, noncrystalline magnetic metallic alloys having positive magnetostriction;
   b. subjecting said sample to a thickness reduction by rolling at a temperature less than its crystallization temperature and maintaining its amorphous character, increasing its coercivity, and reducing its remanence;
   c. subjecting said sample to a tensile stress less than the elastic limit of the alloy; and
   d. sustaining said tensile stress, thereby producing, during said sustaining step, an amorphous alloy having further altered superior soft magnetic properties including increased remanence and reduced coercivity.

5. A method as described in claim 4 wherein said sample is selected from the class of nickel-iron based amorphous alloys.

6. A method as described in claim 4 wherein said sample is subjected to a magnetic field of predetermined amplitude during said stress subjecting step.

7. A method as described in claim 6 wherein said field comprises the field impressed in said sample by application of a periodic electrical signal of predetermined frequency and amplitude.

8. A method as described in claim 6 wherein said selecting step comprises the step of selecting an alloy consisting essentially of: nickel, 40 atomic percent; iron, 40 atomic percent; phosphorous, 14 atomic percent; and boron, 6 atomic percent.

* * * * *